US006796522B2

(12) United States Patent
Braun

(10) Patent No.: US 6,796,522 B2
(45) Date of Patent: Sep. 28, 2004

(54) REEL-LESS LINE RETRIEVER

(76) Inventor: Cindy R. Braun, EP1064 Hemlock La., Stratford, WI (US) 54484

( * ) Notice: Subject to any disclaimer, the term of this patent is extended or adjusted under 35 U.S.C. 154(b) by 0 days.

(21) Appl. No.: 10/342,412

(22) Filed: Jan. 14, 2003

(65) Prior Publication Data

US 2003/0136870 A1 Jul. 24, 2003

Related U.S. Application Data

(60) Provisional application No. 60/407,642, filed on Sep. 3, 2002, and provisional application No. 60/351,022, filed on Jan. 23, 2002.

(51) Int. Cl.[7] ..... B65H 51/10; B65H 54/76; B65H 75/36; B66D 3/00

(52) U.S. Cl. ..... 242/360; 226/177; 226/186; 254/382

(58) Field of Search ..... 242/360; 254/382; 226/177, 186, 187

(56) References Cited

U.S. PATENT DOCUMENTS 2,726,062 A * 12/1955 Sherwood ..... 254/382
3,556,431 A * 1/1971 Henrik et al. ..... 254/382
3,750,970 A * 8/1973 Tremoulet, Jr. ..... 254/382
4,354,667 A * 10/1982 Svendsen ..... 254/382
4,383,516 A 5/1983 La See
4,828,225 A * 5/1989 Owen et al. ..... 254/382
4,944,465 A * 7/1990 Levine ..... 242/360

* cited by examiner

*Primary Examiner*—John M. Jillions
(74) *Attorney, Agent, or Firm*—Quarles & Brady LLP

(57) ABSTRACT

A reel-less line retriever suitable for rescue work provides open housing and guides such as may receive a flexible line along its length without threading through the guides and housing to be positioned between a pair of engaging wheels. The wheels are compressed about the line by a trigger mechanism and activated by a crank so as to discharge the line loosely into a following bucket or other suitable container. A handle may be held by an operator allowing the device to be supported in one hand with control of the trigger with one finger of that hand while the other hand is used to activate the crank. The line may be fully removed from the device and the device from the container for storage or ready access to the line.

17 Claims, 2 Drawing Sheets

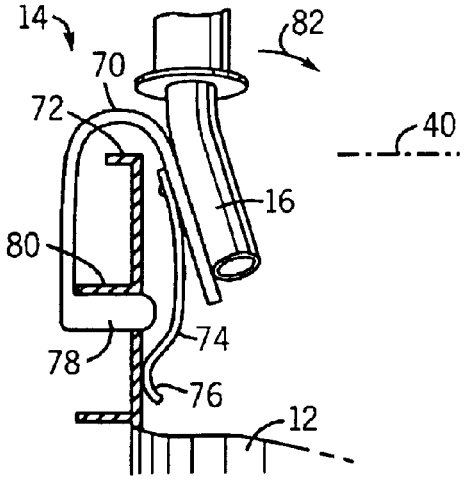
FIG. 3
FIG. 4
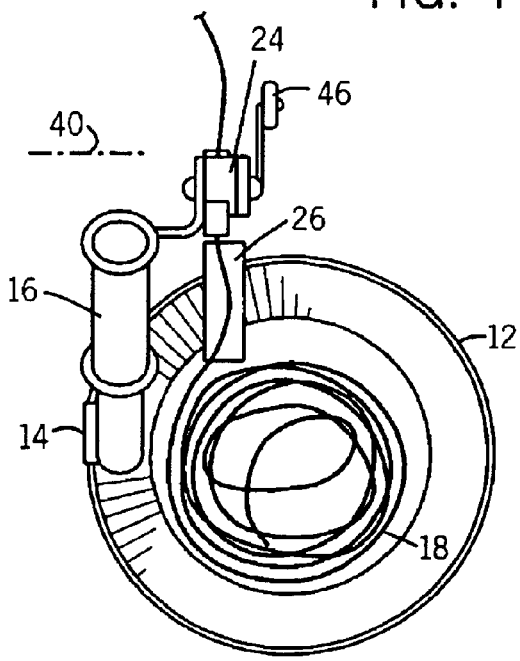
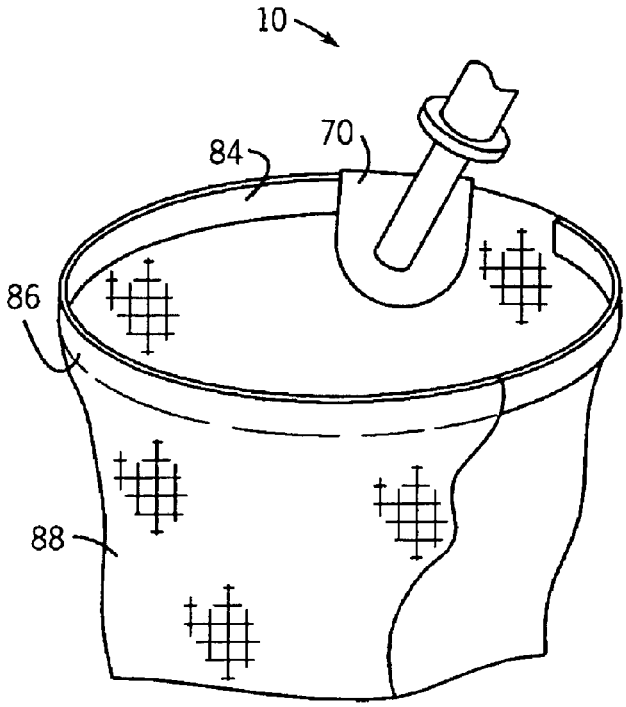
FIG. 5
FIG. 6
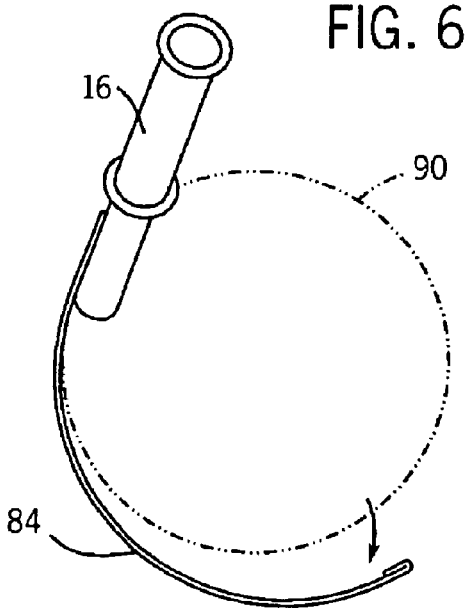

REEL-LESS LINE RETRIEVER

CROSS-REFERENCE TO RELATED APPLICATIONS

This application claims the benefit of U.S. Provisional applications Ser. No. 60/407,642 filed Sep. 3, 2002 and Ser. No. 60/351,022 filed Jan. 23, 2002.

STATEMENT REGARDING FEDERALLY SPONSORED RESEARCH OR DEVELOPMENT

BACKGROUND OF THE INVENTION

The present invention relates to devices for retrieving flexible lines and, in particular, to a device which collects a retrieved line in loose coils for later rapid deployment in rescue or tree trimming operations.

In tree trimming, it is often necessary to pull a climbing rope over a tree limb and in rescue operations, it may be necessary to project a line to a distant point or over an obstacle. A large slingshot has been developed for these purposes and may shoot a bag, filled with lead shot and attached to a small diameter line, several hundred feet. The line, before being deployed, is held loosely coiled in a container such as a net bag. Because the line is collected in loose coils, as opposed to being wound on a spool, the need to abruptly accelerate the mass of the spool and the entirety of the wound line is avoided, increasing the distance that the bag with lead shot may be shot.

In between shots, the line must be retracted and stored again in loose coil form in the bag. In order to promote the desired loose coiling, the line is preferably stuffed into the bag by hand. This is a burdensome operation and, particularly for rescue operations, may be unacceptably time consuming.

BRIEF SUMMARY OF THE INVENTION

The present invention provides an apparatus for quickly retrieving line and loosely coiling it into a container. The line may be inserted at any point along its length between a pair of wheels of the retrieving apparatus. The wheels grip the line and turn to discharge the line into an attached container. The line may be fully removed from the retrieving apparatus before being shot out eliminating drag against the wheels.

Specifically, the invention provides a line retriever for gathering a flexible line. The line retriever has at least one wheel rotatable about a transverse axis and a biasing means urging the wheel perpendicular to the transverse axis, toward an opposed surface, to capture the flexible line between the wheel and the opposed surface. A crank is connected to the wheel to rotate the same and a housing supports the wheel and the opposed surface and is open on one side to allow transverse insertion of the line between the wheel and opposed surface, and removal of the line between the wheel and opposed surface. A handle is attached to the housing to be grasped by the operator in one hand while allowing operation of the crank with the operator's other hand.

It is thus one object of the invention to provide a method of rapidly retrieving a line without the use of a spool or other winding form. The invention may thus be useful in applications like in tree trimming, rescue, or the like, where lines must projected over a distance.

Another object of the invention is to provide a simple line retriever, which may be completely removed from the line before projection of the line for improved projection distance.

The biasing means may be a trigger operable by the operator's finger of the hand holding the handle.

It is another object of the invention to provide a biasing means that may be precisely controlled by the operator and which will provide tactile feedback to the operator of knots, obstructions, or other jamming material that might be brought along with the line. It is another object of the invention to provide an apparatus that may be operated in the field by a single individual.

The opposed surface may be a second wheel rotatable about a transverse axis.

Thus, it is another object of the invention to provide a mechanism that reduces abrasion or wear on the line during the retrieval process.

The line retriever may include a collection container support attached to the handle to hold a container to receive the flexible line discharged from the wheel.

Thus it is another object of the invention to control the location of the collection container with respect to the wheel such as promotes the desired loose coiling.

The handle, as grasped by the operator, may attach at its upper end to the housing and at its lower end to a collection container support.

It is another object of the invention to provide an improved balance for the retrieval device so that the line falls into a container at the bottom of the handle stabilizing the device in upright configuration.

The collection container support may be a spring clip engaging the rim of a bucket.

It is thus another object of the invention to allow removal of the collection container so as to provide unencumbered use of the line.

The spring clip may include outer teeth engaging a bucket ridge and an inner spring finger pressing a wall of the bucket outward against the teeth.

It is thus another object of the invention to provide a container holder that works with a variety of standard bucket sizes.

The collection container support may be a C-shaped hoop compressible to fit within a cloth bag.

Thus, it is another object of the invention to allow the present device to work with a nonrigid container such as may be conveniently stowed.

The device may include front and rear guides releasably holding the flexible line as it enters and exits from the wheel engagement.

Thus, it is another object of the invention to provide for improved management of the line to promote a kinkless and tangle free coiling of the line.

The device may include a shutter finger closing the open side of the housing when the wheel is engaged with the opposing surface.

It is thus another object of the invention to allow free access of the line for insertion and removal at any time from the device, but to prevent inadvertent escape of the line during retrieval.

These particular objects and advantages may apply to only some embodiments falling within the claims and thus do not define the scope of the invention.

BRIEF DESCRIPTION OF THE DRAWINGS

FIG. 3 is a cross-sectional view through the bucket of FIG. 1 showing an engagement of container support on a lower portion of the handle with a rim of the bucket to hold the bucket to the lower portion of the handle;

FIG. 4 is a top plan view of the line retractor of the present invention as attached to a bucket showing alignment of a rear guide of the line retractor with the bucket for loose coiling of the line within the bucket;

FIG. 5 is a view of an alternative embodiment of the container support comprising a spring hoop fitting within the upper seam of a cloth bag shown in partial fragmentary view; and FIG. 6 is a top plan view of the container support of FIG. 5 without the bag and with the spring hoop in a relaxed state.

DETAILED DESCRIPTION OF THE PREFERRED EMBODIMENT

Figures 1, 2:
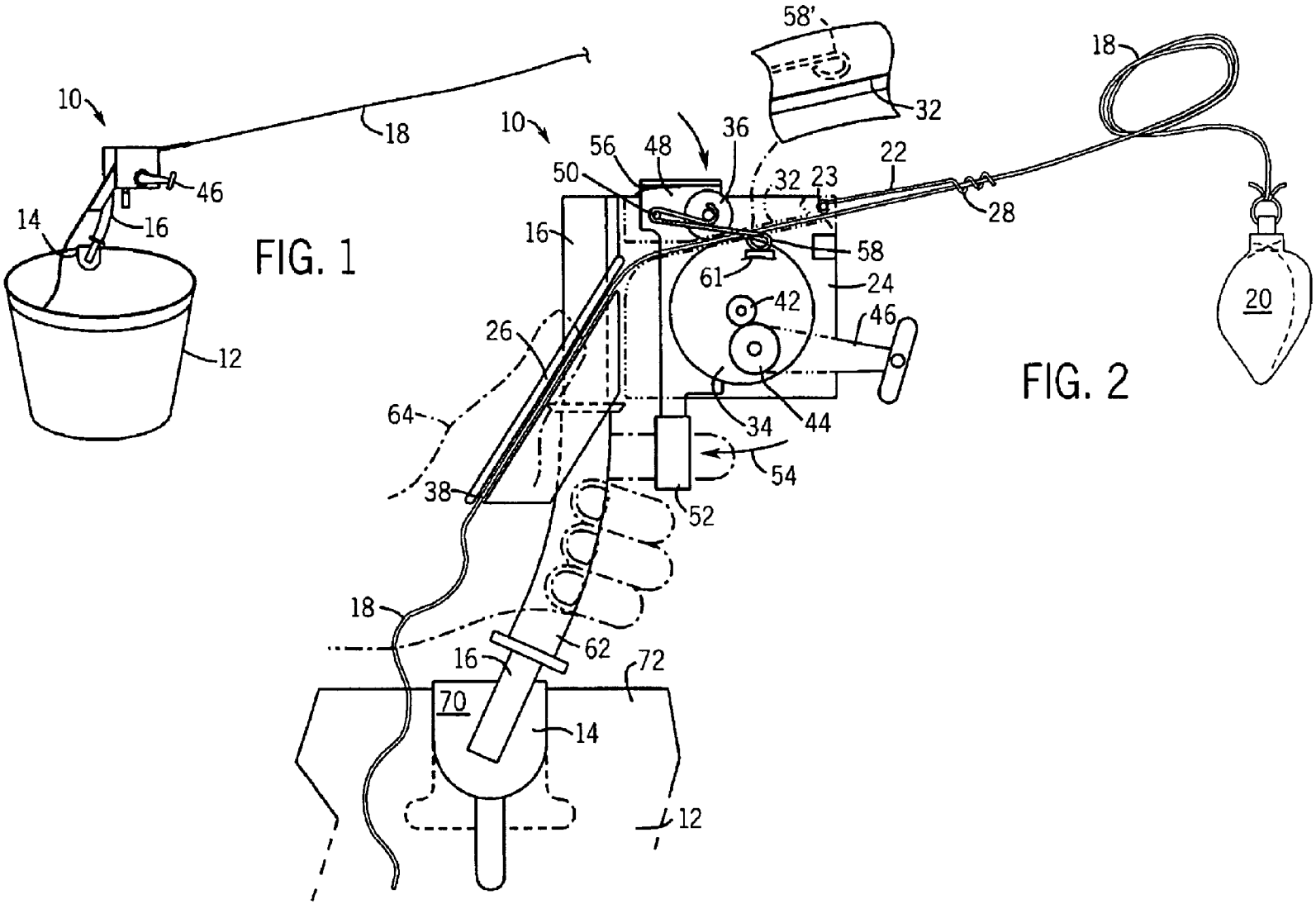
FIG. 1 is a small, perspective view of the line retractor of the present invention as attached to a bucket during retrieval of a line.
FIG. 2 is a side elevational view of the line retractor of FIG. 1 with the housing in partial cutaway showing engagement of retractor wheels with the line when a trigger is pulled by an operator holding the retractor handle.

Referring now to FIG. 1, a reel-less line retractor 10 of the present invention attaches to a standard plastic bucket 12 or other container by means of a container support 14 supported by a lower end of a handle 16 held by the operator. A line 18 to be retrieved is inserted into the line retractor 10 and then, by operation of a crank arm 46, drawn through the line retractor 10 to be discharged into the bucket 12 where the line 18 coils loosely. The weight of the line and of the bucket 12 at the lower end of the handle 16 provides stability and balance to the line retractor 10.

After being retracted, the remainder of the line 18 may be removed from the line retractor 10 and the line retractor 10 removed from the bucket 12. This allows storage of the line retractor and/or unimpeded access to the line 18 when the line 18 is being projected.

Referring now to FIG. 2, a front end of the line 18 may be attached to a lead-shot filled bag 20 or the like to provide a weight that may be thrown by a sling shot or other device to pull the line 18 along with it. The line 18 may be, for example, a standard nylon braided cord having a flattened cross section, for example, sold by Sherrill Arborist Supply of Greensboro, N.C.

As described above, the process of retracting the line 18 begins with the insertion of a length of the line 18 into the line retractor 10 which involve inserting the line into a front guide 22, a housing 24 of the line retractor 10, and a rear guide 26 from which it is expelled into the bucket 12.

The front guide 22 is formed from a rod attached at a loop 23 in its proximal end to a front edge of the housing 24. The loop 23 allows the front guide 22 to pivot in a vertical plane for accepting the line 18 from a variety of different angles without extreme angulation of the housing 24. It also pivots over the housing for storage.

A distal end of the front guide 22 is formed in a pigtail 28 being a loose helical spiral wrapping about the line 18 to guide it toward the housing 24. The spiral of the pigtail 28 eliminates the need to thread one end of the line 18 through the pigtail 28 (and thus to have access to a free end of the line 18) but allows a length of the line 18 to be wound along the helix of the pigtail 28 until it is fully surrounded by the pigtail 28. Thus the line 18 may be inserted into the front guide 22 after the lead-shot filled bag 20 has been thrown and with the other end of the line 18 remaining in the bucket 12 and possibly tied thereto.

A slot 32 is formed in the right side of the housing 24 allowing the line 18 to be inserted into the housing 24 along a transverse direction (perpendicular to the plane of FIG. 2) at any point along the length of the line. Within the housing 24, the line 18 is received between a drive wheel 34 and idler wheel 36 as will be described.

The line 18 may exit a rearward edge of the housing 24 and be received by the rear guide 26. The rear guide 26 is generally a rectangular tube having, like the housing 24, a slot 38 formed in the right side allowing transverse removal or insertion of the line 18 into the rear guide 26. In the preferred embodiment, the rear guide 26 is formed of a transparent plastic so as to allow visual inspection of the line 18.

Rear guide 26 is attached to the housing 24 so as to extend downwardly at approximately 45° to discharge the line 18 approximately in the center of the bucket 12 as shown in FIG. 4 when the bucket 12 is attached to the container support 14. Line 18 thus discharged, coils loosely in the bottom of the bucket 12 allowing rapid removal of the line 18 at a later time without tangling or kinking.

Referring now to FIGS. 2 and 4, the drive wheel 34 and the idler wheel 36 are supported within the housing 24 to turn about transverse axes 40 in coplanar opposition. Initially, the circumferences of the drive wheel 34 and the idler wheel 36 are separated so that the line 18 may fit between the drive wheel 34 and the idler wheel 36 when line 18 is placed through the slot 32 within the housing 24. The axle of the drive wheel 34 is fixed with respect to the housing 24 and attached on its right end to a spur gear 42. The spur gear 42 engages a drive gear 44 attached to a crank arm 46. Rotation of the crank arm 46, accessible on the right side of the housing 24, turns the drive wheel 34 within the housing 24. Drive gear 44 is larger than spur gear 42 to provide approximately 3:1 increase in rotational speed.

The idler wheel 36 is not attached directly to the housing 24 but instead attached to a rocker plate 48 that in turn pivots about a pivot point 50 with respect to the housing 24. The rocker plate 48 attaches to a downwardly extending trigger 52 which with leftward motion 54 causes downward movement of the idler wheel 36 against the upper circumference of the drive wheel 34 to engage the line 18 once line 18 has been inserted in the housing 24 between the drive wheel 34 and idler wheel 36.

Pressure on the line 18, as gripped between the idler wheel 36 and drive wheel 34 is adjusted by pressure on the trigger 52 by a finger of the operator as will be described. A bias spring 56 extending between the housing 24 and the rocker plate 48 provides an opposing force on the rocker plate 48 disengaging the idler wheel 36 from the drive wheel 34 when pressure is removed from the trigger 52.

This mechanism described above is adapted generally from a device used in the art of bow fishing in which fish are captured using a bow and arrow. This device is the subject of a separate U.S. Pat. No. 4,383,516 assigned to the assignee of the present invention and hereby incorporated by reference.

Referring still to FIG. 2, a shutter finger 58 is attached to the rocker plate 48, for example, by winding a spring wire about the pivot point 50 and the axel of the idler wheel 36 so as to extend downward from an upper portion of the housing 24 past the slot 32 to abut an anvil 61 when the trigger 52 is pulled leftward 54. The shutter finger 58 thus captures the line 18 within the housing 24 when the trigger 52 is engaged preventing the line 18 from jumping out of the slot 32. Conversely when the trigger 52 is not depressed, and the rocker plate moves counter-clockwise under the urging of spring 56, the shutter finger 58 moves to an upward position shown by 58' above the slot 32 allowing retrieval or insertion of the line 18 freely through the slot 32. The spring wire of which the shutter finger 58 is constructed may flex slightly when it engages the anvil 61 eliminating problems of tolerance stack up.

Attached at a rear edge of the housing 24 is a tubular handle 16 extending downward therefrom to be received within a cushioned grip 62 that may be grasped by the operator's left hand 64 with the operator's index finger received by the trigger 52 and the remaining fingers wrapped around the cushioned grip 62. In this manner, the operator may easily support the line retractor 10 and operate the trigger 52 with one hand. The line 18 is kept free from the operator's hand by the rear wall of the rear guide 26. With this holding of the line retractor 10, the operator's right hand may operate the crank arm 46 whose clockwise rotation causes a counterclockwise rotation of the drive wheel 34 accelerating the line 18 rearward through the rear guide 26.

A lower portion of the tubular handle 16, after passing through the cushioned grip 62, connects to a container support 14 such as may releasably grip the bucket 12.

Referring now to FIGS. 2 and 3, the container support 14 attached to the lower end of the handle 16 may include a saddle 70 fitting over a rim 72 of the bucket 12. An inner portion of the saddle 70 holds between itself and an inner wall of the bucket 12, a leaf spring 74 having its upper end attached to an upper portion of the saddle 70 and a lower finger 76 pressing inward against the inner vertical wall of the bucket 12. The outer portion of the saddle 70 provides at its lower end inwardly extending teeth 78 engaging the undersurface of a radially extending flange 80 on the bucket 12 providing a resistance against upward movement of the saddle 70 with respect to the bucket 12 when the saddle 70 is so engaged.

A rightward tipping of the handle indicated by arrow 82 compresses the spring 74 allowing disengagement of the teeth 78 so that an upward movement of the handle 16 will separate the container support 14 from the bucket 12. In this way after the line 18 is retracted, the line 18 may be removed from the line retractor 10 and the line retractor 10 removed from the bucket 12 to eliminate interference between the line retractor 10 and the line 18 or for storage of the line retractor 10 as may be desired. To reinstall the bucket 12 to the container support 14, the operation is simply reversed.

Referring now to FIGS. 5 and 6 in an alternative embodiment, a circular hoop 84 is mounted directly to the saddle 70 expanding in a plane that is generally horizontal and that may fit within an upper seam 86 of a cloth bag 88. Referring to FIG. 6, the hoop 84 naturally expands to a greater radius than the radius 90 of the cloth bag 88 so as to be compressible to fit within the cloth bag 88 and to retain it. Again, the bag 88 may be removed from the line retractor 10 which may be disengaged from the line 18 after completion of the retrieval operation.

It is specifically intended that the present invention not be limited to the embodiments and illustrations contained herein. For example, the idler wheel 36 could be replaced with a stationary slip plate, the trigger could be replaced with a spring normally holding the drive wheel 34 and idler wheel 36 together to be separated only for insertion of the line 18, or the device could be driven by an electric motor. Modified forms of the above embodiments including portions of the embodiments and combinations of elements of different embodiments, may come within the scope of the following claims

I claim:

1. A line retriever for gathering a flexible line comprising:

at least one wheel rotatable about a transverse axis;

a biasing means drawing together the wheel and an opposed surface in a direction perpendicular to the transverse axis to capture the flexible line between the wheel and the opposed surface;

a crank connected to the wheel to rotate the same;

a housing supporting the wheel and opposed surface and being open on one side to allow transverse insertion of the line between the wheel and opposed surface, and removal of the line from between the wheel and opposed surface; and a handle attached to the housing to be grasped by the operator in one hand and positioned to allow operation of the crank with the operator's other hand.

2. The line retriever of claim 1 wherein the biasing means is a trigger operable by the operator's finger.

3. The line retriever of claim 1 wherein the opposed surface is a second wheel rotatable about a transverse axis.

4. The line retriever of claim 1 further including a collection container support attached to the handle to hold a container to receive the flexible line discharged from the wheel.

5. The line retriever of claim 4 wherein the handle as grasped by the operator attaches to the housing at an upper end and to the collection container support at a lower end.

6. The line retriever of claim 4 wherein the collection container support is a spring clip engaging the rim of the bucket.

7. The line retriever of claim 6 wherein the spring clip includes outer teeth engaging a bucket ridge and an inner spring finger pressing a wall of the bucket outward against the teeth.

8. The line retriever of claim 4 wherein the collection container support is a C-shaped hoop compressible to fit within a cloth bag.

9. The line retriever of claim 1 further including a collection container selected from the group consisting of a cloth bag and a plastic bucket.

10. The line retriever of claim 1 further including a front guide attached to the housing and extending perpendicularly to the transverse axis to receive the flexible line as drawn into between the wheel and the opposing surface.

11. The line retriever of claim 10 wherein the front guide is a pig tail releasably engaging the flexible line.

12. The line retriever of claim 1 further including a back guide attached to the housing and extending rearward to receive the flexible line discharged from between the wheel and the opposing surface and discharge it toward a collection container.

13. The line retriever of claim 12 wherein the back guide is a slotted tube.

14. The line retriever of claim 13 wherein the tube is transparent.

15. The line retriever of claim 1 further including a shutter finger closing the open side of the housing when the wheel is engaged with the opposing surface.

16. A line retriever for gathering a flexible line comprising:

a pair of opposed wheels rotatable about transverse axes;

a trigger connected to at least one wheel to move the wheel perpendicularly to the transverse axes to capture the flexible line between the opposed wheels;

a crank connected to at least one wheel to rotate the same;

a housing supporting the wheels therein and being open on one side to allow transverse insertion of the line between the wheels, and removal of the line from between the wheels;

a handle, attached at its upper end to the housing, to be grasped by the operator in one hand allowing operation of the trigger with a finger of the one hand and positioned to allow operation of the crank with the operator's other hand;

a collection container support attached at a lower end of the handle and positioned to receive line discharged from the wheels along a direction perpendicular to the transverse axes.

17. A method of throwing and retracting lines comprising the steps of:

(a) attaching a weight to the line and throwing the weight;

(b) inserting the line into a line retractor of a type having at least one wheel rotatable about a transverse axis, a biasing means drawing together the wheel and an opposed surface in a direction perpendicular to the transverse axis to capture the flexible line against an opposed surface, a crank connected to the wheel to rotate the same;

a housing supporting the wheel and the opposed surface and being open on one side to allow transverse insertion of the line between the wheel and opposed surface, and removal of the line from between the wheel and opposed surface;

and a handle attached to the housing to be grasped by the operator in one hand and positioned to allow operation of the crank with the operator's other hand;

(c) positioning a collection container near the line retractor; and (d) turning the crank to wind the flexible line loosely in the collection container.

* * * * *